US006155696A

United States Patent [19]

Winton et al.

[11] Patent Number: 6,155,696

[45] **Date of Patent: *Dec. 5, 2000**

[54] LIGHTING ASSEMBLY RAISED AND LOWERED ALONG POLE

[75] Inventors: Timothy G. Winton, deceased, late of Westerville, by Brenda B. Winton, administrator; Dennis R. Blansit, St. Louisville; Robert A. Catone; Charles M. Hohman, both of Granville, all of Ohio

[73] Assignee: NSI Enterprises, Inc., Newark, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/081,755

[22] Filed: May 20, 1998

[51] Int. Cl.[7] ..... F21V 21/14

[52] U.S. Cl. ..... 362/250; 362/249; 362/391; 362/403; 362/410; 362/431

[58] Field of Search ..... 362/249, 250, 362/410, 414, 431, 285, 286, 384, 391, 401, 403

[56] References Cited

U.S. PATENT DOCUMENTS

| | | | |
|---|---|---|---|
| 3,696,241 | 10/1972 | Meyer et al. | 362/250 |
| 4,512,117 | 4/1985 | Lange | 52/6 |
| 4,851,980 | 7/1989 | McWilliams et al. | 362/250 |
| 4,862,336 | 8/1989 | Richardson et al. | 362/285 |
| 5,205,101 | 4/1993 | Swan et al. | 522/650.1 |
| 5,237,792 | 8/1993 | Oberman et al. | 52/645 |
| 5,274,534 | 12/1993 | Armstrong | 362/249 |
| 5,278,742 | 1/1994 | Garrett | 362/233 |
| 5,551,199 | 9/1996 | Hayes et al. | 52/648.1 |
| 5,623,786 | 4/1997 | DeMeyer | 52/6 |
| 6,026,626 | 2/2000 | Fisher | 52/633 |

FOREIGN PATENT DOCUMENTS

| | | | |
|---|---|---|---|
| 996085 | 8/1976 | Canada | 362/431 |
| 1448181 | 6/1966 | France | 362/431 |
| 197805 | 4/1978 | France | 362/431 |
| WO 90/04133 | 4/1990 | WIPO | 362/249 |

OTHER PUBLICATIONS

Sportstar, GE Lighting Systems, Inc., Advertisement, Lighting Design + Application, Sports Lighting, Jan., 1998.

*Primary Examiner*—Cassandra Spyrou
*Assistant Examiner*—John Juba, Jr.

[57] ABSTRACT

A lighting system is adapted to receive lighting fixtures and is capable of being raised and lowered along the length of an attendant pole which has a longitudinal axis is moved by a transport mechanism having a plurality of cables which extend from the lighting system to the base of the attendant pole. The lighting system includes at least one support member is which is co-axially aligned with the longitudinal axis of the pole. Further included is a pair of transverse members which are oriented substantially parallel to each other and are attached by a plurality of cross-members extending therebetween. Each of the pair of transverse members is disposed on opposite sides of the at least one support member.

7 Claims, 6 Drawing Sheets

LIGHTING ASSEMBLY RAISED AND LOWERED ALONG POLE

TECHNICAL FIELD

This invention relates to a lighting assembly adapted for mounting to a pole.

BACKGROUND ART

Athletic fields serving both the amateur and professional ranks of sports such as soccer, football and baseball, often have lighting units or fixtures available to provide sufficient light to permit sporting events to take place during the twilight and evening hours. Such lighting units are commonly attached to a pole having a service platform mounted to the pole top, thereby providing a stable surface for supporting an operator when maintenance of the lighting unit is necessary. Access for repair and maintenance of features such as lamp replacement and ballast repair of the lighting unit is typically via pole steps or a bucket truck. But pole steps may provide undesired parties with access to the lighting units and the use of a bucket truck may be awkward and time consuming, as well as inaccessible to particular areas and impracticable under certain circumstances.

Further, current lighting fixture and pole assemblies commonly include a low number of lighting units, thus requiring more frequent and closer placement of the assemblies in the field. Moreover, the lighting units of these assemblies generally are focused in a single direction, thereby necessitating multiple assemblies positioned close to each other should two fields be placed side-by-side and require lighting.

Consequently, a need has developed for a lighting fixture for mounting to a pole, which is adapted for lighting outdoor fields and sporting venues. The lighting fixture should be easy to access and maintain. Such fixture should also resolve the need for multiple fixtures positioned close to each other. Such device should further be able to light adjoining field or areas without great difficulty and permit orientation of attached luminaires in one or more directions.

BRIEF SUMMARY OF THE INVENTION

It is an object according to the present invention to provide a lighting assembly which is easier to maintain and access.

It is another object according to the present invention to provide a lighting assembly which provides sufficient light to require fewer lighting fixtures in proximity to each other.

It is still another object according to the present invention to provide a lighting assembly which is illuminate in more than one direction.

It is yet another object according to the present invention to provide a lighting assembly which is able to illuminate adjacent areas or wherein the lighting units are capable of being oriented for directing light in different directions.

In carrying out the above objects, features and advantages of the present invention, provided is a lighting assembly adapted to receive lighting fixtures and which is capable of being raised and lowered along the length of an attendant pole having a longitudinal axis. This raising and lowering of the system is accomplished by a transport mechanism having a plurality of cables which extend from the lighting system to the base of the pole. The lighting system includes at least one support member which is co-axially aligned with the longitudinal axis of the pole. Further included is a pair of transverse members which are oriented substantially parallel to each other and are also attached by a plurality of cross-members extending therebetween. Each of the pair of transverse members is disposed on opposite sides of the at least one support member. In one embodiment, a plurality of fixture mounts are included for attaching the lighting fixtures to each of the pair of transverse members. In other embodiments, the pair of transverse members define one of either a horizontal plane or an angled plane. Still in other embodiments, the pair of transverse members and the at least one support member share a common plane. Still further, each of the pair of transverse members is substantially long relative to the diameter of the attendant pole.

Yet another embodiment of a lighting system according to the present invention includes a frame having front and rear transverse members which are oriented parallel to each other and have a plurality of cross-members extending therebetween, the front and rear transverse members and the plurality of cross-members defining a plane. This lighting system also includes a transport device having an annular support member which is concentrically disposed about the pole in a horizontal plane. The front and rear transverse members are each mounted to opposite sides of the annular support member. The transport mechanism also includes a plurality of cables attached to the support member in order to permit the control of raising and lowering the frame along the length of the pole.

In a preferred embodiment, the frame has a parallelogram shaped cross-section which is defined by a first planar face and a second planar face which are oriented opposite each other, and is further defined by a first angled face and a second angled face oriented opposite each other. The first planar face is defined by an upper transverse member and a one of the front and rear transverse members. The second planar face is defined by a lower transverse member and an other of the front and rear transverse members. The first angled face is defined by the lower transverse member and the other of the front and rear transverse members. The second angled face is defined by the lower transverse member and the one of the front and rear transverse members. In one embodiment, the first and second planar faces are each substantially perpendicular to horizontal plane. In another embodiment, each of the front, rear, upper and lower transverse members have lighting fixtures mounted thereon.

The above objects and other objects, features and advantages of the present invention are readily apparent from the following detailed description of the best modes for carrying out the invention when taken in connection with the accompanying drawings wherein like reference numerals correspond to like components.

BEST MODE FOR CARRYING OUT THE INVENTION

Figure 1:
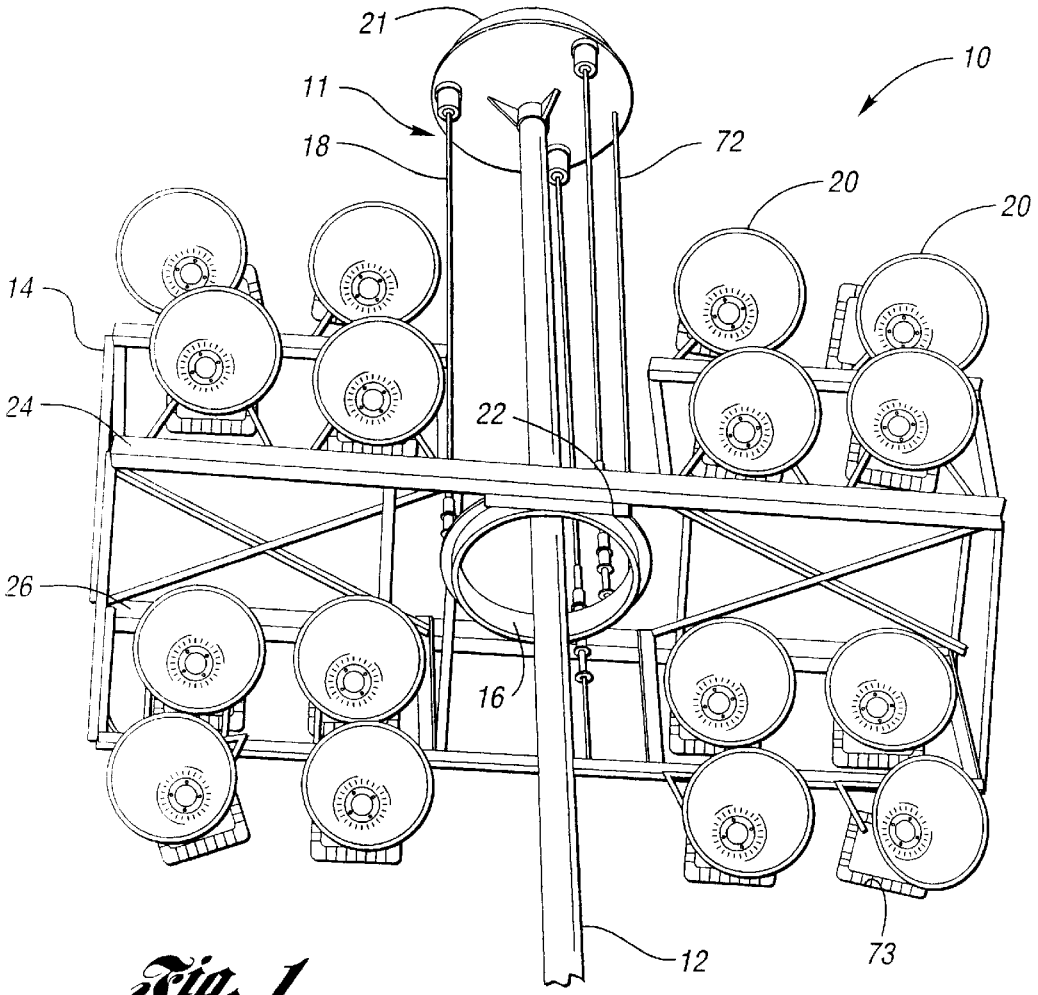
FIG. 1 is an illustration of the lighting unit and pole assembly according to the present invention.
Figure 2:
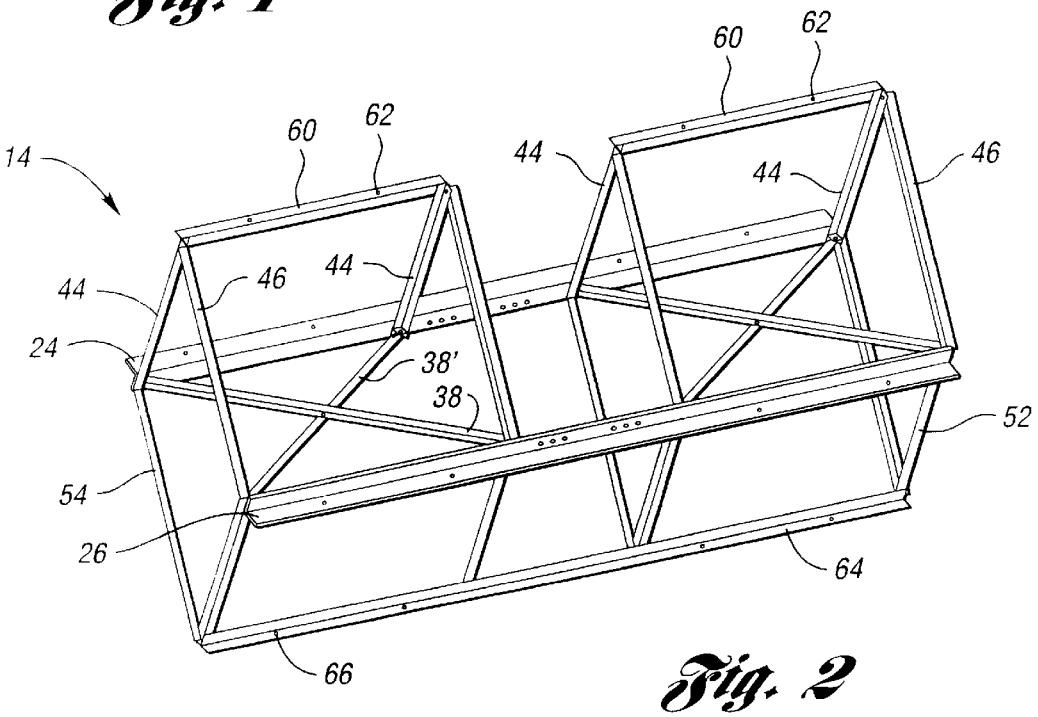
FIG. 2 is a perspective view of a lighting frame according to the present invention, and is particularly a rear perspective view of the lighting frame illustrated in FIG. 1.
Figure 3:
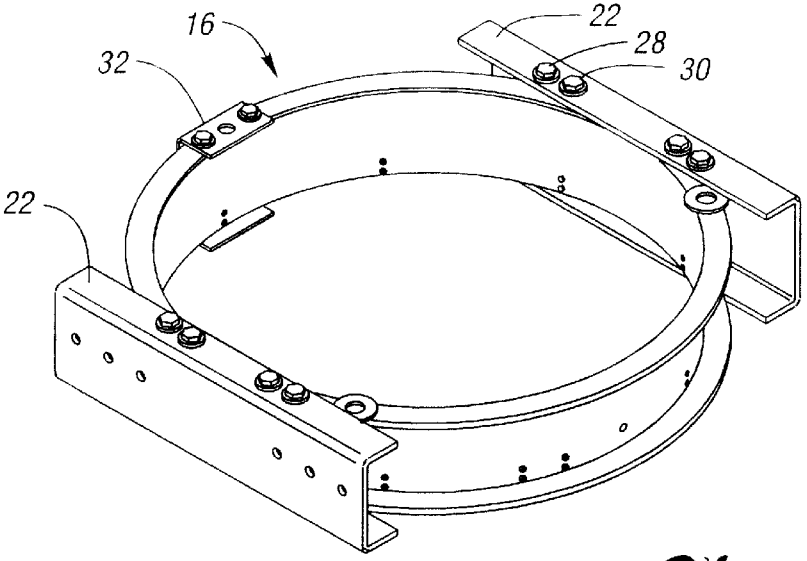
FIG. 3 is a perspective view of a support member according to the present invention.
Figure 5:
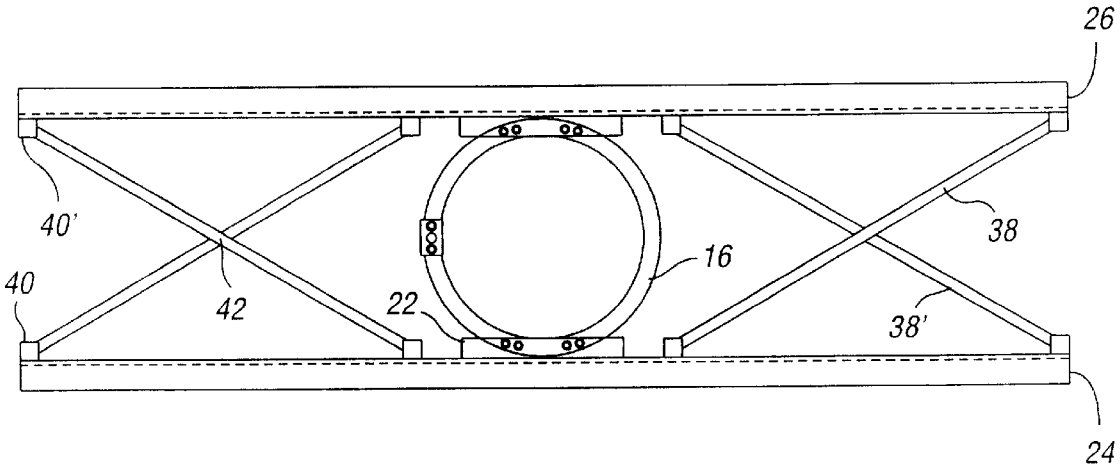
FIG. 5 is a cross-sectional view along the line 5—5 of FIG. 4.

Referring to FIG. 1 of the drawings, shown therein is a lighting unit and pole assembly 10 according to the present invention. Particularly, lighting unit and pole assembly 10 includes a pole 12, a frame 14, and a plurality of luminaires 20 (or lighting fixtures). In the embodiment illustrated in FIGS. 1 and 2, frame 14 resembles a cage and thus may also be referred as a lighting cage. Lighting unit and pole assembly 10 further includes a raising/lowering system subassembly 11 (or a transport mechanism) which itself includes, among other components, a support member 16 and a plurality of hoisting cables 18, as will be discussed more fully herein. Support member 16 preferably has an annular shape as illustrated in FIGS. 1, 3 and 5. Pole 12 is sufficiently tall to permit the light distribution desired for the intended application and has a longitudinal axis.

With regard to the mobility of frame 14 and support ring 16 along pole 12, in the embodiment disclosed in FIG. 1, there are provided three hoisting cables 18 for lowering and raising frame 14 along the length of pole 12 in conjunction with support member 16. Cables 18 are commonly heavy-duty aircraft cables formed of aircraft-grade steel and zinc electroplated to meet Type A Federal Specification RR-W-410a. Frame 14 and support member 16 are preferably formed of a grade of galvanized steel sufficient to withstand the environmental conditions an outdoor assembly is likely to encounter. Of course, the use of assembly 10 is not limited to outdoor applications and may also be used to illuminate indoor settings, such as stadiums or arenas, as well.

Figure 12:
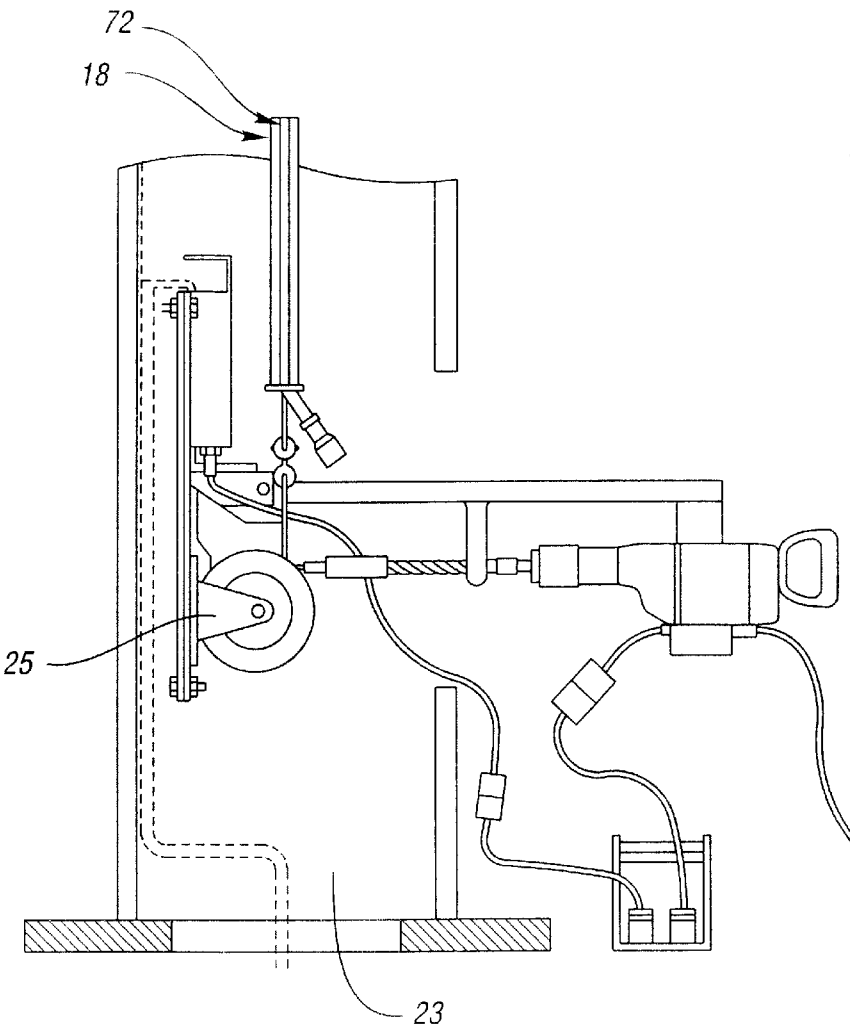
FIG. 12 is a side elevational view of the base of the pole according to the present invention illustrating the winch assembly portion of the transport mechanism.
Figure 11:
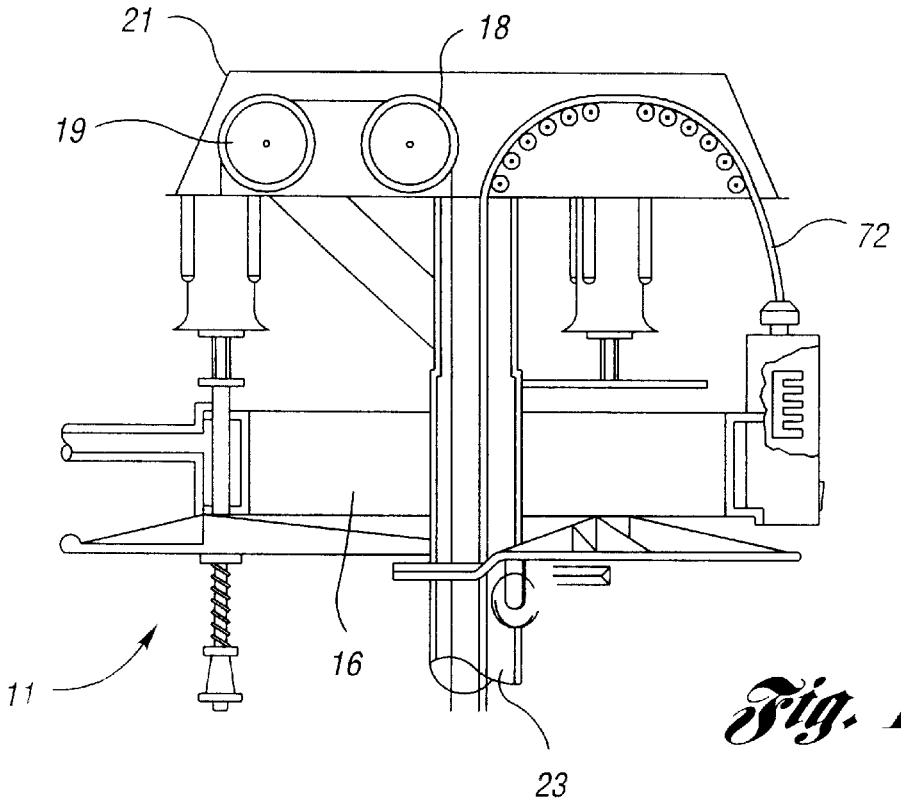
FIG. 11 is a side elevational view of the upper portion of the pole according to the present invention illustrating the pulley portion of the transport mechanism.

With reference again to FIG. 1, it is shown therein that support member 16 is centrally disposed within frame 14. Raising/lowering system 11 is one which is capable of moving frame 14 about pole 12 and along the length of pole 12 and its general operation is well-known in the art. For example see U.S. Pat. No. 4,198,022 entitled "Power Cable Guide For High-Mast Luminaire Raising and Lowering System", which is incorporated fully herein by reference, and is the preferred means and method for moving frame 14 along the length of pole 12 from generally ground level to the top or upper region of pole 12 via hoisting cables 18. Generally, the hoisting cables 18 are mounted to and extend from support member 16 through a pulley system 19 that is typically located at the top of pole 12, under poletop cover 21 as shown in FIG. 1 and 11. Cables 18 extend down through the interior 23 of pole 12 to the base of the pole (see FIG. 12) where they connect to a power winch assembly 25 which operates the transport mechanism, as is well known in the art. It is also in the base of pole 12 where the power is provided to assembly 10, as is known in the art.

Figure 13:
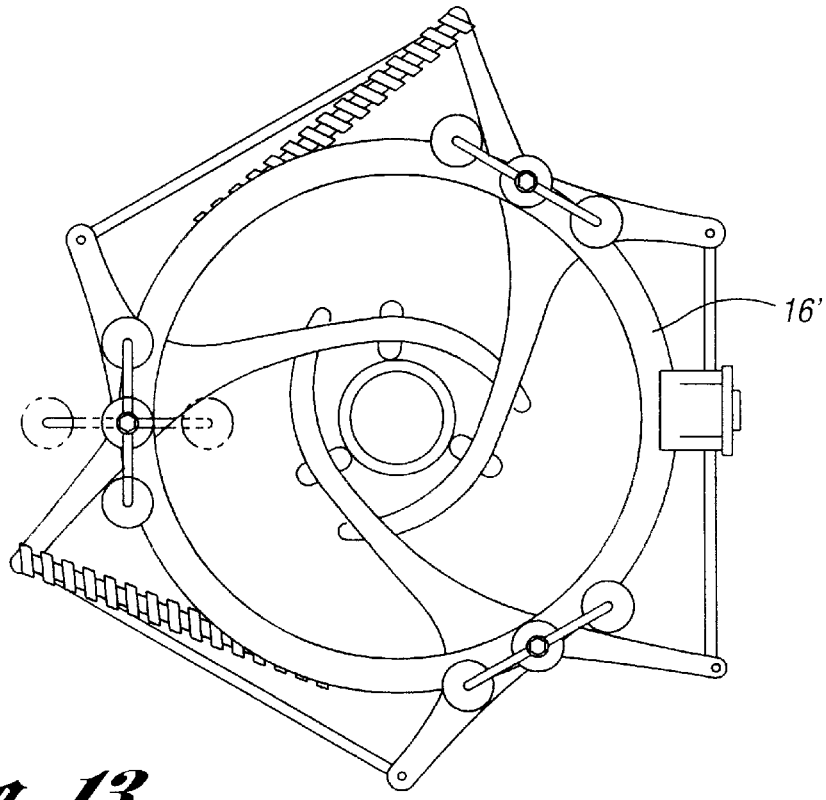
FIG. 13 is a top view of another embodiment the support member according to the present invention, illustrating a mechanism for centering the support member on the attendant pole.

In the embodiment illustrated in FIG. 1 of the drawings herein, no affirmative contact is made between support member 16 and pole 12. However, in other embodiments it is contemplated that support member 16' may be centered about pole 12, as shown FIG. 13, by way of engagement between pole 12 and support member 16' via an apparatus and method known in the art and generally disclosed in U.S. Pat. No. 3,847,833 entitled "Method and Apparatus For Centering A Luminaire Support", which is incorporated fully herein by reference. It is noted in the embodiment shown in FIG. 1 that, in operation, support member 16 is oriented in a horizontal plane which is generally parallel to the ground, is disposed concentrically about pole 12, and is co-axially aligned with pole 12.

With reference again to FIGS. 1 and 2, frame 14 includes a pair of transverse members—front transverse member 24 and rear transverse member 26—which are oriented substantially parallel to each other and thereby define a plane. Transverse members 24 and 26 are each mounted to opposite sides of support member 16 through corresponding mounting brackets 22, and accordingly, are also disposed on opposite sides of pole 12. Each of transverse members 24 and 26 is longitudinally aligned relative to pole 12 and has a relative length greater than the diameter of pole 12. Each of transverse members 24 and 26 is oriented generally perpendicular to pole 12, although the resultant plane defined by the pair of transverse members may not be perpendicular to pole 12.

Figure 4:
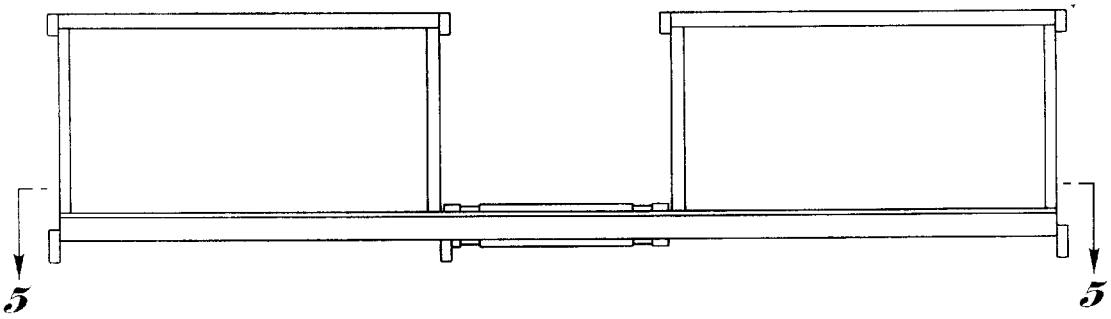
FIG. 4 is a partial rear elevational view of a lighting frame and attached support member according to the present invention.

In the embodiment shown in FIG. 4, support member 16 is co-planar with the plane defined by front transverse member 24 and rear transverse member 26, said plane also being generally parallel to the ground. Of course, as previously mentioned, support member 16 need not be co-planar with transverse members 24 and 26 to achieve the teachings according to the present invention.

Support member 16 is attached or mounted to frame 14 by way of a pair of support member mounting brackets 22. Specifically, each one of the pair of mounting brackets 22 is attached to a corresponding one of the front and rear transverse members 24, 26, as is shown in FIG. 5, which is a sectional view taken along the line 5—5 of FIG. 4.

As illustrated in FIG. 3, each mounting bracket 22 is shown attached to support member 16 by way of a plurality of screws with hex heads or threaded studs with hex nuts attached thereto 28, in conjunction with corresponding washers 30. Of course, it is contemplated that mounting bracket 22 may be attached to support member 16 by a variety of appropriate fastening methods, of which the one illustrated is just an example. Also shown in FIG. 3 is a relatively smaller channel mounting bracket 32 mounted to support member 16 in a manner similar to that described above in association with mounting bracket 22. Smaller mounting bracket 32 is typically used to mount a wiring chamber 70 for providing electrical power to the plurality of luminaires 20 via a main power cable 72, best shown in FIGS. 1 and 7–9.

As is known in the art, power cable 72 runs from a power inlet 70 over a single pulley, down through the interior of the pole to the pole base, where it connects to a power source by way of a twistlock disconnect and circuit breaker. In the region of the disconnect, power cable 72 is attached to the hoisting cables 18 such that when frame 14 is to be lowered, power cable 72 is disconnected from the power source so that the bulk of the power cable moves outwardly through the pole, around the power cable pulley at the top of the pole and downwardly on the outside of the pole with the lowering lighting assembly. (See FIGS. 11–12).

As is further illustrated in FIGS. 1, 3, and 5, each mounting bracket 22 is mounted to its corresponding one of the front and rear transverse members 24 and 26 by way of a plurality of screws and washers, similar to the fasteners described above regarding the attachment with support member 16. Particularly, it is noted in FIG. 2 that each mounting bracket 22 has a plurality of holes 34 formed therein, which are aligned with a plurality of holes 36 formed in a corresponding transverse member 24 and 26 through which screws or other fastening means are inserted for attaching each bracket 22 to a transverse member 24, 26.

With reference again to FIG. 5, note that a plurality of cross-members 38, 38' is provided for securing front transverse member 24 to rear transverse member 26 and for providing greater stability to the lighting cage 14. Note that a total of four cross-members 38, 38' are shown in FIG. 5. In FIGS. 1–2 and 4–5 it is illustrated that the plane defined by cross-members 38, 38' is generally co-planar with the plane defined by front and rear transverse members 24 and 26 as well as that of support member 16. Of course, while one cross-member 38 lies above another cross-member 38', they may be said to lie generally in the same plane for the purposes herein. Each cross-member 38, 38' is attached at either end to the front transverse member 24 and rear transverse member 26 at points 40 and 40'. Each cross-member 38 is also attached to its corresponding cross-member 38' at a position 42 centrally located along each cross-member 38, 38'. Like before, these attachments 40, 40' and 42 are shown to be screws, nuts and washers, but may also be any of a variety of fasteners. Transverse members 24 and 26 each provide for a mounting base to which operatively mounts a plurality of luminaires 20. As shown in FIG. 1 and as more fully shown in FIGS. 7–9, four luminaires 20 are mounted to front transverse member 24 and four luminaires 20 are mounted to rear transverse member 26.

With reference again to FIG. 2 of the drawings, illustrated therein is a perspective view of frame 14 of assembly 10 according to the present invention. Frame 14 is illustrated herein as a framed unit having various transverse and cross-members which define the various faces of cage 14. The various transverse members also provide mounting bases to which luminaires 20 may be mounted or otherwise attached, as shown in FIGS. 1 and 7–10.

Figure 6:
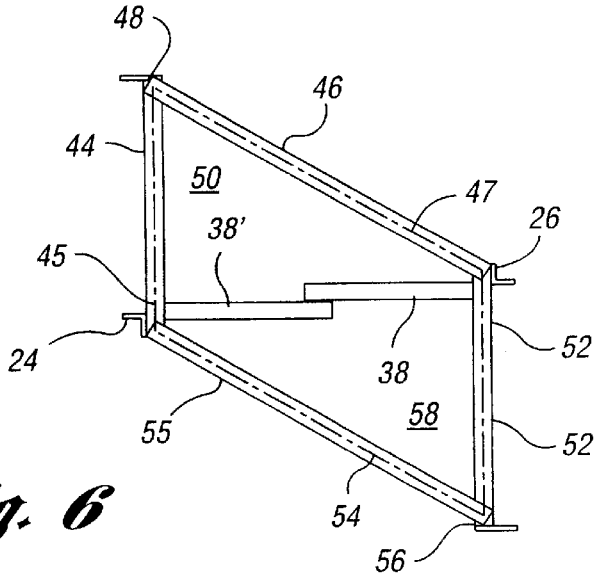
FIG. 6 is a side elevational view of the lighting frame according to the present invention.

With attention now directed to FIG. 6, shown therein is a side elevational view of lighting cage 14 according to the present invention. Note that various cross-members and transverse members define a triangular shaped area both above and below the horizontal plane defined by front and rear transverse members 24, 26 and cross-members 38, 38'. More particularly, note that the side elevational views shown in FIGS. 6 and 9 resembles a parallelogram in shape.

Particularly, in forming this parallelogram shaped cross-section, an upper vertical member 44 is mounted at its lower end 45 to front transverse member 24, while upper cross-member 46 (or brace) is mounted at its lower end 47 to rear transverse member 26 via mechanical fasteners including, but not limited to, bolts and nuts, rivets, or welding. Note that the upper portions of each upper vertical member 44 and upper cross-member 46 are attached to each other at location 48 to form the triangular upper section 50. As shown in FIG. 2, illustrated therein are four upper vertical members 44 and four upper cross-members 46 across the transverse length of frame 14.

Similarly, with reference again directed to FIG. 6, lower vertical member 52 is mounted at its upper end 53 to rear transverse member 26, while lower cross-member 54 is mounted at its upper end 55 to front transverse member 24. Like their counterpart members 44 and 46, note that lower vertical member 52 and lower cross-member 54 are attached to each other at location 56 to form the triangular-shaped lower section 58. Upper and lower vertical members 44, 52 are shown as generally perpendicular to the corresponding transverse member 24, 26, respectively, to which they are attached. It is further noted in FIG. 6 that upper and lower diagonal cross-members 46 and 54 are generally parallel to each other, while upper and lower frame members 44 and 52 are likewise generally parallel to each other. Note with reference to FIG. 2 that there are four lower vertical members 52 and four lower cross-members 54 across the transverse length of lighting cage 14.

Figure 7:
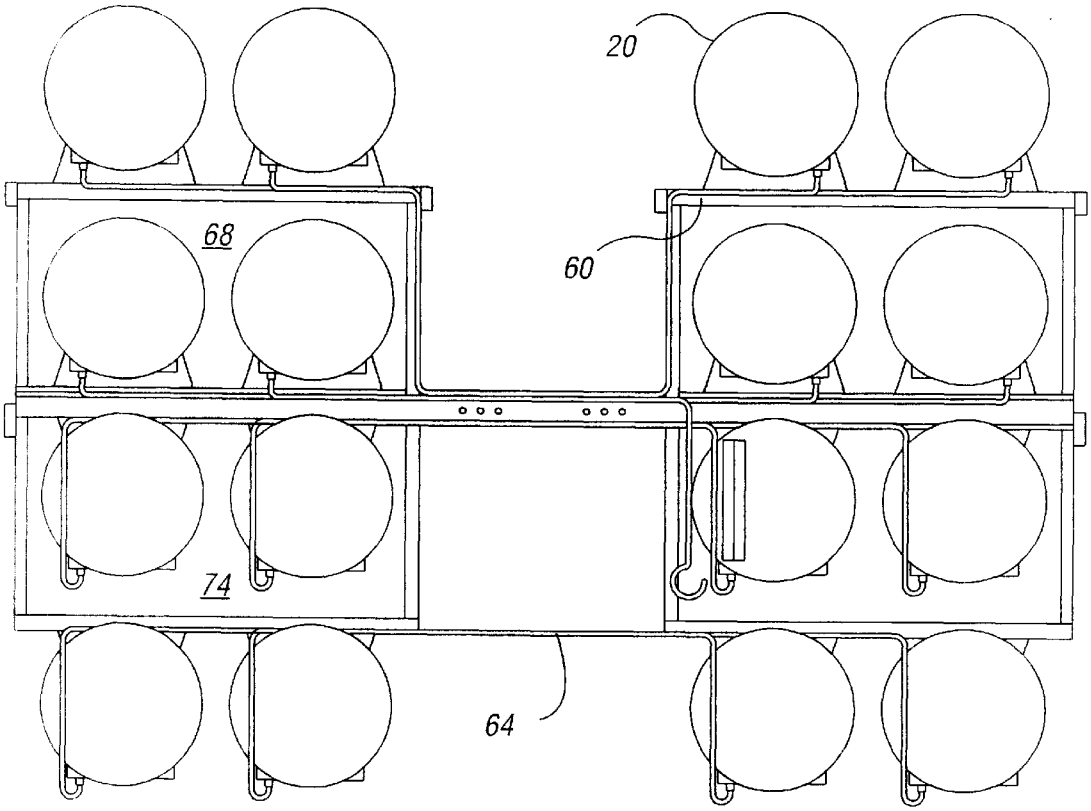
FIG. 7 is a front elevational view of the lighting frame assembly according to the present invention.
Figure 8:
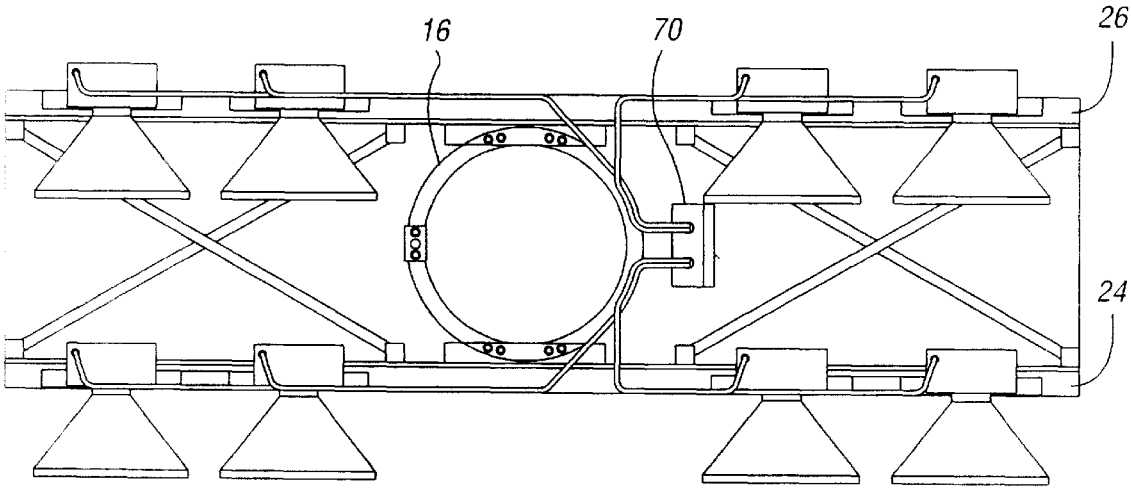
FIG. 8 is a top plan view of the lighting frame assembly of FIG. 7 according to the present invention.

With further reference to FIGS. 2 and 4, shown provided therein is a pair of upper transverse members 60 which are co-linearly aligned with each other and which form a line along which each upper vertical member 44 meets with a corresponding upper cross-member 46. It is contemplated that the pair of upper transverse members 60 may be provided as a single upper transverse member. FIGS. 2 and 4 also indicate the presence of mounting holes 62 via which luminaires 20 are attached to upper transverse members 60, the result of which is illustrated in FIGS. 1 and 7–8. Particularly, each luminaire 20 has attached thereto a U-shaped mounting brackets 65 (otherwise known as mounting members or yokes) which is then adjustably mounted via standard fasteners through hole 62 for mounting to a corresponding transverse member 24, 26, 60, 64. The adjustable functionality of mounting bracket 73 also allows luminaires 20 to move and to be directed in various directions and orientations with respect to its corresponding transverse member. For example, refer to FIG. 10 which illustrates that front luminaires 20 may be oriented in one direction, while rear luminaires 21 may be oriented in a second—in this case opposite—direction. Thus one lighting cage and pole assembly 10 may be used to illuminate two distinct areas, such as adjoining playing fields.

Figure 9:
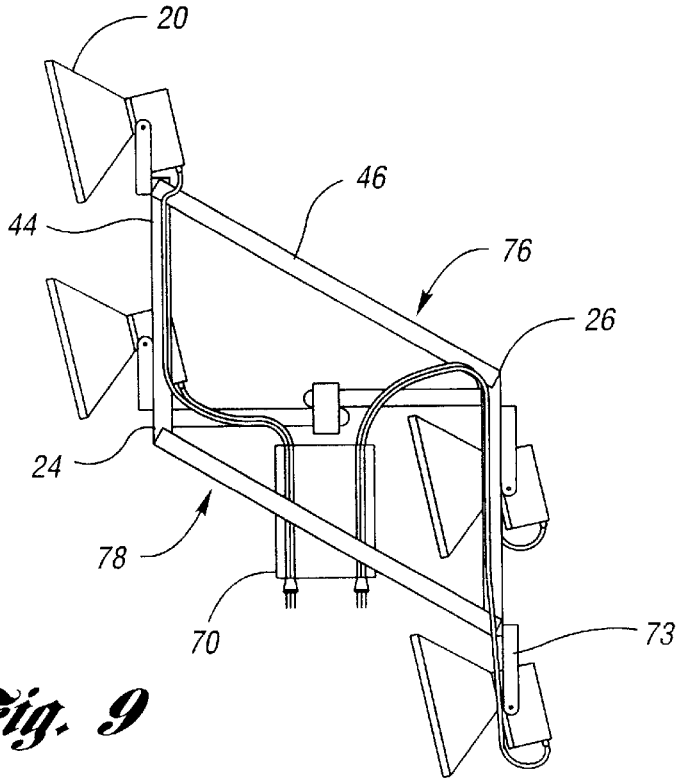
FIG. 9 is a side elevational view of the lighting frame assembly of FIG. 7 according to the present invention.

FIG. 2 and 7 also illustrate a lower transverse member 64 which defines a line along which each lower frame member 52 is attached to a corresponding lower diagonal member 54. Lower transverse member 64 also has mounting holes 66 allowing a plurality of luminaires 20 to be attached to lower transverse member 64, as shown in FIGS. 1, 7 and 9.

Figure 10:
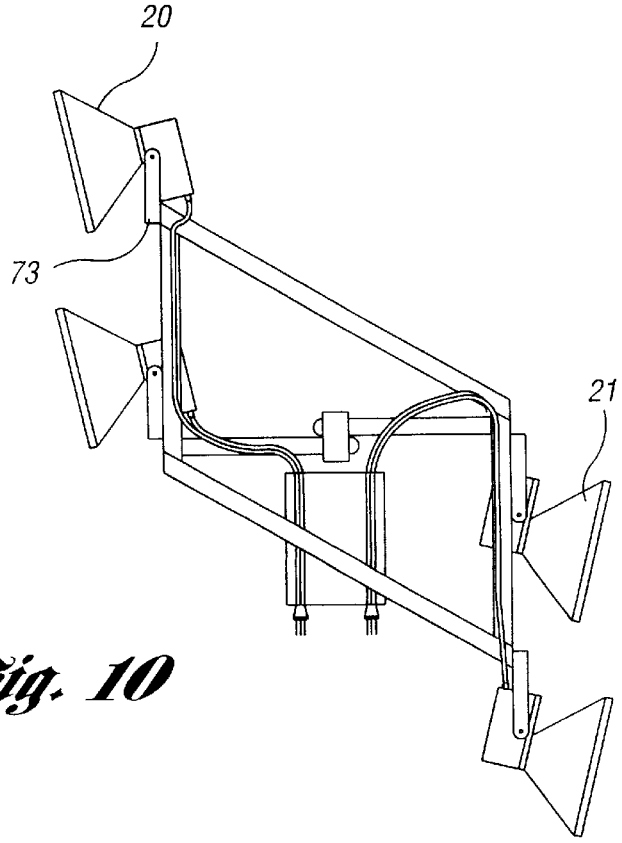
FIG. 10 is a side elevational view of another embodiment of the lighting frame assembly according to the present invention, wherein luminaires are oriented in different directions.

Again with reference to FIGS. 7–9, sixteen luminaires 20 are provided in association with cage 14: four along front transverse member 24, four along lower transverse member 64, four along rear transverse member 26, and four along upper transverse members 60. As an alternate description, eight luminaires 20 are mounted or otherwise suspended from a front upper planar face 68 of frame 14 which is defined by front transverse member 24 and upper transverse members 60; meanwhile, another eight luminaires 20 are mounted or otherwise suspended from the rear-lower planar face 74 of frame 14 defined by rear transverse member 26 and lower transverse member 64. Each luminaire 20 is mounted to its corresponding cross-member by the aforementioned U-shaped mounting bracket 73 (best shown in FIG. 1 and 9). As shown in FIGS. 9 and 10, luminaires 20 are wired through power inlet 70 for providing power thereto.

An upper angled face 76 is a plane defined by rear transverse member 26 and upper transverse member 60, and is further defined by upper cross-members 46. Likewise, a lower angled face 78 is a plane defined by front transverse member 24 and lower transverse member 64, and is further defined by lower cross-members 54. Depending on the number of luminaires 20 needed to be mounted to frame 14 for the desired application, it is contemptated that frame 14 need not include all of the various members disclosed herein.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A lighting assembly comprising:

a pole;

a support member orientable about the pole and co-axially aligned therewith;

a frame having first and second transverse members substantially parallel with each other and having cross-members extending therebetween, each of the first and second transverse members mounted to the support member on opposite sides thereof, each of the first and second transverse members defining a pair of substantially vertical planar faces with an upper and lower transverse member, respectively, and each of the first and second transverse members further defining a pair of angled planar faces with the lower and upper transverse member, respectively;

a plurality of luminaires mounted to the each of the first and second transverse members capable of being directed in a plurality of orientations; and a plurality of cables attached to the support member to permit the control of raising and lowering the frame along the length of the pole.

2. The lighting assembly of claim 1 wherein the frame defines a parallelogram cross-section wherein the pair of vertical planar faces are parallel and opposite each other, and the pair of opposed angled planar faces are parallel and opposite each other.

3. The lighting assembly of claim 1 wherein the support member and the first and second transverse members are co-planar.

4. The lighting assembly of claim 3 wherein the support member and the first and second transverse members define a horizontal plane.

5. A lighting system adapted to receive a plurality of lighting fixtures which is capable of being raised and lowered along the length of an attendant pole, the lighting system comprising:

a frame having front and rear transverse members oriented parallel to each other and having a plurality of cross-members extending therebetween, the front and rear transverse members and the plurality of cross-members defining a plane, the frame further having a parallelogram shaped cross-section defined by a first planar face and a second planar face oriented opposite each other, and a first angled face and a second angled face oriented opposite each other, wherein the first planar face is defined by an upper transverse member and a one of the front and rear transverse members, the second planar face is defined by a lower transverse member and an other of the front and rear transverse members, the first angled face is defined by the lower transverse member and the other of the front and rear transverse members, and the second angled face is defined by the lower transverse member and the one of the front and rear transverse members; and a transport mechanism having an annular support member co-axially disposed about the pole in a horizontal plane, the front and rear transverse members mounted to opposite sides of the support member, the transport mechanism also including a plurality of cables attached to the support member to permit the control of raising and lowering the frame along the length of the pole.

6. The lighting system of claim 5, wherein the first and second planar faces are each substantially perpendicular to the horizontal plane.

7. The lighting system of claim 5, wherein each of the front, rear, upper, and lower transverse members receive lighting fixtures.

* * * * *